US010801090B2

(12) United States Patent
Zhao et al.

(10) Patent No.: US 10,801,090 B2
(45) Date of Patent: Oct. 13, 2020

(54) ULTRA HIGH OBDURABILITY STEEL PLATE HAVING LOW YIELD RATIO AND PROCESS OF MANUFACTURING SAME

(71) Applicant: BAOSHAN IRON & STEEL CO., LTD., Shanghai (CN)

(72) Inventors: Sixin Zhao, Shanghai (CN); Hongsheng Jiang, Shanghai (CN); Liandeng Yao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 177 days.

(21) Appl. No.: 14/761,488

(22) PCT Filed: Dec. 24, 2013

(86) PCT No.: PCT/CN2013/090270
§ 371 (c)(1),
(2) Date: Jul. 16, 2015

(87) PCT Pub. No.: WO2014/114159
PCT Pub. Date: Jul. 31, 2014

(65) Prior Publication Data

US 2015/0354040 A1 Dec. 10, 2015

(30) Foreign Application Priority Data

Jan. 22, 2013 (CN) ..... 2013 1 0022288

(51) Int. Cl.
*C22C 38/54* (2006.01)
*C21D 8/02* (2006.01)
(Continued)

(52) U.S. Cl.
CPC ..... *C22C 38/54* (2013.01); *C21D 1/25* (2013.01); *C21D 6/004* (2013.01); *C21D 6/005* (2013.01);
(Continued)

(58) Field of Classification Search
CPC ..... C22C 38/54; C22C 38/50; C22C 38/48; C22C 38/46; C22C 38/44; C22C 38/06;
(Continued)

(56) References Cited

U.S. PATENT DOCUMENTS 9,011,614 B2 * 4/2015 Nakagaito ..... C22C 38/02 148/320
2014/0124102 A1 * 5/2014 Zhang ..... C22C 38/001 148/506
(Continued)

FOREIGN PATENT DOCUMENTS

CN 1924065 A 3/2007
CN 101045977 A 10/2007
(Continued)

OTHER PUBLICATIONS

English Translation of CN 102747303 A (Year: 2012).*
(Continued)

*Primary Examiner* — Alexandra M Moore
(74) *Attorney, Agent, or Firm* — Quarles & Brady LLP

(57) ABSTRACT

The invention discloses an ultra-high obdurability steel plate having a low yield ratio, comprising the chemical elements in mass percentages of: C: 0.18-0.34%, Si: 0.10-0.40%, Mn: 0.50-1.40%, Cr: 0.20-0.70%, Mo: 0.30-0.90%, Nb: 0-0.06%, Ni: 0.50-2.40%, V: 0-0.06%, Ti: 0.002-0.04%, Al: 0.01-0.08%, B: 0.0006-0.0020%, N≤0.0060%, O≤0.0040%, Ca: 0-0.0045%, and the balance of Fe and other unavoidable impurities. The invention also discloses a process of manufacturing the steel plate, wherein the heating temperature is 1080-1250° C.; the quenching temperature is 860-940° C.; and the tempering temperature is 150-350° C.

7 Claims, 1 Drawing Sheet

(51) Int. Cl.

| | |
|---|---|
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 1/25*** | (2006.01) |
| *C21D 1/19* | (2006.01) |
| *C21D 9/46* | (2006.01) |

(52) U.S. Cl.

CPC ..... *C21D 6/008* (2013.01); *C21D 8/0221* (2013.01); *C21D 8/0247* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C21D 1/19* (2013.01); *C21D 9/46* (2013.01); *C21D 2211/001* (2013.01); *C21D 2211/008* (2013.01)

(58) Field of Classification Search

CPC ..... C22C 38/04; C22C 38/02; C22C 38/002; C22C 38/001; C21D 8/0221; C21D 8/0263; C21D 6/004; C21D 6/005; C21D 6/008; C21D 1/19; C21D 1/25; C21D 8/0247; C21D 9/46

See application file for complete search history.

(56) References Cited

U.S. PATENT DOCUMENTS

| | | | | |
|---|---|---|---|---|
| 2014/0230969 | A1* | 8/2014 | Sugimoto | C22C 38/38 148/330 |
| 2014/0322559 | A1* | 10/2014 | Becker | C21D 1/19 428/659 |

FOREIGN PATENT DOCUMENTS

| | | | | |
|---|---|---|---|---|
| CN | 101629476 | A | * | 1/2010 |
| CN | 101775545 | A | | 7/2010 |
| CN | 102161148 | A | | 8/2011 |
| CN | 102191438 | A | | 9/2011 |
| CN | 102471849 | A | | 5/2012 |
| CN | 102534416 | A | | 7/2012 |
| CN | 102534423 | A | | 7/2012 |
| CN | 102747272 | A | * | 10/2012 |
| CN | 102747303 | A | | 10/2012 |
| CN | 103060715 | A | | 4/2013 |
| EP | 1563105 | A1 | | 8/2005 |
| EP | 2267177 | A1 | | 12/2010 |
| EP | 2524970 | A1 | | 11/2012 |
| JP | 359166621 | A | | 9/1984 |
| JP | H0617188 | A | | 1/1994 |
| JP | H09165646 | A | | 6/1997 |
| JP | H09227988 | A | | 9/1997 |
| JP | H11229090 | A | | 8/1999 |
| JP | 2004300474 | A | | 10/2004 |
| JP | 2006203118 | A | | 8/2006 |
| JP | 2006283117 | A | | 10/2006 |
| JP | 2006283118 | A | | 10/2006 |
| JP | 2006307334 | A | | 11/2006 |
| JP | 2007009324 | A | | 1/2007 |
| JP | 2007009325 | A | | 1/2007 |
| JP | 2009122841 | A | | 6/2009 |
| JP | 2009235549 | A | | 10/2009 |
| JP | 2009242841 | A | | 10/2009 |
| JP | 2010047805 | A | | 3/2010 |
| JP | 2010138421 | A | | 6/2010 |
| JP | 2011214120 | A | | 10/2011 |
| JP | 2012036501 | A | | 2/2012 |
| RU | 2010121834 | A | | 12/2011 |
| WO | 2007051080 | A2 | | 5/2007 |
| WO | 2012141265 | A1 | | 10/2012 |
| WO | 2012161248 | A1 | | 11/2012 |
| WO | WO-2012156428 | A1 | * | 11/2012 ..... C21D 1/19 |
| WO | WO 2013038741 | A1 | * | 3/2013 ..... C22C 38/38 |

OTHER PUBLICATIONS

English Machine Translation CN 101629476 (Year: 2010).*

CN 102747272 A Machine Translation (Year: 2020).*

The State Intellectual Property Office of People's Republic of China, Search Report, Application No. 201300222888, dated Sep. 29, 2014.

The State Intellectual Property Office of People's Republic of China, First Office Action, Application No. 2013100222888, dated Sep. 29, 2014.

European Patent Office, Extended European Search Report, Application No. 13872503.1, dated Aug. 4, 2016.

European Patent Office, Communication pursuant to Article 94(3) EPC, EP Application No. 13 872 503.1, dated May 18, 2018, 6 pages.

Decision of Refusal issued in corresponding Japanese Application No. 2015-552985 dated Aug. 28, 2018, 6 pages.

Japan Patent Office, Notification of Reasons for Refusal, Application No. 2015-552985, dated Nov. 14, 2017, 6 pages.

European Patent Office, Communication, Application No. 13872503.1, dated Sep. 14, 2017, 6 pages.

Russian Patent Office, Office Action, Application No. 2015136606, dated Jul. 6, 2017, 7 pages.

Gulyaev, Metallurgical Science, 1986, p. 231, as cited in the Russian Office Action dated Jul. 6, 2017.

PCT International Search Report, PCT/CN2013/090270, dated Mar. 27, 2014, 8 pages.

Communication pursuant to Article 94(3) EPC issued in corresponding European Application No. 13872503.1, dated Feb. 18, 2019, 5 pages.

Intellectual Property India, Examination Report, Application No. 5938/DELNP/2015, dated Nov. 6, 2019, 7 pages.

Japan Patent Office, Notice of Reasons for Refusal, Application No. 2015-552985, dated Jan. 8, 2020, 6 pages.

Korean Intellectual Property Office, Office Action, Application No. 10-2015-7022771, dated Feb. 3, 2020, 7 pages.

* cited by examiner

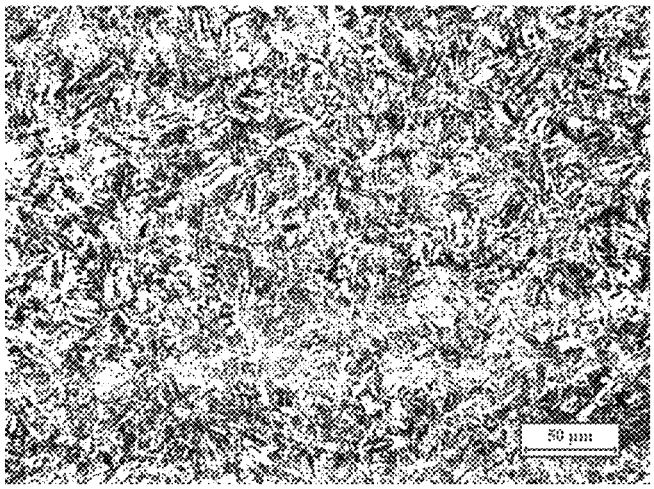
50 μm

ULTRA HIGH OBDURABILITY STEEL PLATE HAVING LOW YIELD RATIO AND PROCESS OF MANUFACTURING SAME

CROSS-REFERENCE TO RELATED APPLICATIONS

This application represents the national stage entry of PCT International Application No. PCT/CN2013/090270 filed Dec. 24, 2013, which claims priority of Chinese Patent Application No. 201310022288.8 filed Jan. 22, 2013, the disclosures of which are incorporated by reference here in their entirety for all purposes.

TECHNICAL FIELD

The invention relates to a steel plate and a process of manufacturing the same, particularly to an ultra-high obdurability steel plate and a process of manufacturing the same.

BACKGROUND ART

High obdurability steel plates are widely used for mechanical structures, architectures, bridges and engineering structures. The mechanical properties of a steel plate include yield strength, tensile strength, elongation, low temperature impact energy, etc. When steel plates are selected for structural members such as mechanical structures, architectures, bridges and the like, yield strength is generally taken as a yardstick and a certain safety factor is afforded. The ratio of yield strength to tensile strength is termed yield ratio. In engineering applications, yield ratio is principally embodied by a safety factor in a course which begins from the yielding of a steel plate to its complete failure when a structural member is subject to an ultimate stress surpassing the yield strength. If the yield ratio of a steel plate is low, the steel plate will have a large safety space before the stress reaches the tensile strength and causes the material to break or the structure to lose stability when the steel plate is subject to a stress higher than the yield strength. If the yield ratio of a steel plate is high, the stress of the steel plate will reach the tensile strength quickly and break the steel plate once the stress arrives at the yield strength. As such, when high requirements are imposed on the safety properties of a structural member, the use of a steel plate having low yield strength is entailed. For example, for structural members such as steel structures for high buildings, hydroelectric steel penstocks, hydraulic supports in coal mines, etc., a lower yield ratio steel plate is able to absorb more energy when natural disasters such as earthquake, mountain landslide, landslip and the like occur, so as to retard damage to the structures or avoid complete failure of the structures, prevent secondary disasters and alleviate threat to human life.

In the case that the yielding of a steel plate is obvious, yield strength is denoted by upper yield strength and lower yield strength. In the case that the yielding of a steel plate is not obvious, yield strength is denoted by the strength at 0.2% plastic deformation, $Rp_{0.2}$. The upper yield strength of a low carbon steel plate originates from the formation of Cottrell atmosphere from interstitial atoms near dislocations, which impedes start of the movement of the dislocations. Once the dislocations begin to move, the effect of the Cottrell atmosphere vanishes, and the force required to be applied on the steel plate is reduced, so as to form lower yield. If the start of the movement of the dislocations involves interactions between Cottrell atmosphere, dislocation rings and dislocation walls, the yielding phenomenon will not be obvious. Yield strength represents the stress that broadens the slip band due to large-scale dislocation multiplication and movement. According to some literatures, yield strength corresponds to the stress that causes moving edge dislocations to slip out of crystals completely, and tensile strength is the maximum stress that a material can resist during elongation, often accompanied by nucleation, growth and propagation of microcracks.

In the design and manufacture of a steel plate having low yield ratio, microstructures having combined soft and hard phases are usually used to obtain low yield strength and high tensile strength. For example:

A patent literature titled "HIGH STRENGTH DUAL PHASE STEEL WITH LOW YIELD RATIO, HIGH TOUGHNESS AND SUPERIOR WELDABILITY" (publication number: WO2007/051080; publication date: May 3, 2007) discloses a dual phase, high strength steel comprising a composite microstructure of soft and hard phases, wherein the composite microstructure may provide low yield ratio, high strain capacity, superior weldability, and high toughness, wherein the chemical composition of the steel comprises C: 0.03-0.12%, Ni: 0.1-1.0%, Nb: 0.005-0.05%, Ti: 0.005-0.03%, Mo: 0.1-0.6%, Mn: 0.5-2.5%, Cu: ≤1.0%, Cr: ≤1.0%, Ca: ≤0.01%, and the following optional elements of V: ≤0.1%, B: ≤0.002%, Mg: ≤0.006%, N: ≤0.010%, Si: ≤0.5%, Cu: ≤1.0%, Al: ≤0.06%, P: ≤0.015%, S: ≤0.004%. The dual phase steel comprises from about 10% by volume to about 60% by volume of a first phase or component consisting essentially of fine-grained ferrite. The first phase comprises a ferrite having a mean grain size of about 5 microns or less. The dual phase steel further comprises from about 40% by volume to about 90% by volume of a second phase or component comprising: fine-grained martensite, fine-grained lower bainite, fine-grained granular bainite, fine-grained degenerate upper bainite, or any mixture thereof.

A Chinese patent literature titled "800 MPA LEVEL THICK STEEL PLATE WITH HIGH TOUGHNESS AND LOW YIELD RATIO AND ITS MAKING PROCESS" (publication number: CN101045977A; publication date: Oct. 3, 2007) discloses a thick steel plate with high strength, high toughness and low yield ratio and its making process, wherein the chemical composition of the steel plate comprises C: 0.05-0.09 wt %, Si: 0.35-0.45 wt %, Mn: 1.5-1.90 wt %, Ni: 0.30-0.70 wt %, Nb: 0.04-0.08 wt %, Al: 0.02-0.04 wt %, Ti: 0.01-0.04 wt %, wherein the steel plate possesses a low yield ratio and a tensile strength higher than 800 MPa.

A Chinese patent literature titled "700 MPA LEVEL THICK STEEL PLATE WITH HIGH TOUGHNESS AND LOW YIELD RATIO AND ITS MAKING PROCESS" (publication number: CN1924065A; publication date: Mar. 7, 2007) discloses a steel plate having a chemical composition in mass percentages of C 0.03-0.06, Si 0.35-0.55, Mn 1.00-1.55, Ni 0.50-0.70, Nb 0.02-0.06, Al 0.02-0.04, Ti 0.01-0.04, V 0.04-0.07, Cu 0.50-0.70, and the balance of Fe and unavoidable impurities. The making process comprises the following steps: A. smelting and casting into blanks; B. heating to 1180-1220° C.; C. rolling at an initial rolling temperature of 1050-1100° C.; holding on the roll path until the temperature reaches 920-960° C. when the thickness of the rolled pieces is 2-3 times the thickness of the final steel plate; subsequently proceeding with the second stage rolling with deforming quantity at 5-15 mm and rolling pass deforming rate at 10-25%; setting the final rolling temperature at 820-880° C.; D. when the rolling is finished, proceeding with air cooling for 60-120 s; accelerating cooling at 10-20° C./s to 460-600° C.; discharging the steel plate from water, followed by air cooling.

As can be seen, along with the development of large-size, complicated mechanical steel structures, steel plates need increased strength and low yield ratio for the purpose of strengthening and lightening the steel structures as well as saving energy and reducing consumption.

SUMMARY

An object of the invention is to provide an ultra-high obdurability steel plate having a low yield ratio, and a process of manufacturing the same. The steel plate has a high level of tensile strength and a low yield ratio, such that the requirements of low yield, high obdurability, high toughness, increased strength, and reduced weight for steel plates in the fields of mechanical structures, buildings, bridges, engineering structures, etc. are met.

In order to fulfill the above object, the invention provides an ultra-high obdurability steel plate having a low yield ratio, comprising the following chemical elements in mass percentages of:

C: 0.18-0.34%,
Si: 0.10-0.40%,
Mn: 0.50-1.40%,
Cr: 0.20-0.70%,
Mo: 0.30-0.90%,
Nb: 0-0.06%,
Ni: 0.50-2.40%,
V: 0-0.06%,
Ti: 0.002-0.04%,
Al: 0.01-0.08%,
B: 0.0006-0.0020%,
N≤0.0060%,
O≤0.0040%,
Ca: 0-0.0045%, and
the balance of Fe and unavoidable impurities.

Furthermore, the ultra-high obdurability steel plate having a low yield ratio according to the invention has a carbon equivalent CEV≤0.75%, wherein the carbon equivalent CEV=C+Mn/6+(Cr+Mo+V)/5+(Ni+Cu)/15.

As far as the compositional design is concerned, the principle for designing the various chemical elements in the ultra-high obdurability steel plate having a low yield ratio according to the invention will be described as follows:

C: C is able to enlarge the austenite phase zone in a steel plate. Steel plates having various microstructures and mechanical properties may be obtained by modifying the C content in the steel. The type of phase transformation in the steel plate will be different when the amount of C element added into the steel is different. If the contents of C element and alloying elements are low, diffusional phase transformation such as ferrite transformation, pearlite transformation will occur. If the contents of C element and alloying elements are high, martensite transformation will occur. In the case of martensite transformation, C atoms are solid dissolved in the lattice of Fe atoms and elongate the c axis of the crystals, leading to Fcc (face-centered cubic lattice)—Hcp (hexagonal close packed lattice) transformation. C atoms increase the strength of the steel plate significantly by changing the crystalline structure. The stability of austenite is improved as C atoms increase, and martensite and residual austenite may be obtained after the steel plate is cooled rapidly, lowering the yield ratio of the steel plate. However, if the content of C element is unduly high, the plasticity and toughness of the steel plate will be deteriorated. With the influence of C element on the obdurability and superplasticity of a steel plate taken into account comprehensively, the C content in the invention is controlled at 0.18-0.34%.

Si: When added into a steel plate, Si may improve the strength of the steel plate by atom replacement and solid solution strengthening. However, if the Si content is too high, the propensity of hot cracking during welding of the steel plate will be increased. Hence, the Si content in the invention is designed in the range of 0.10-0.40%.

Mn: C and Mn elements are typically used in combination to obtain steel plates having good mechanical properties. Mn element is added into the steel plate of the invention to enhance the obdurability of the steel plate by solid solution strengthening. Since a relatively high amount of C is added into the steel plate of the invention, in order to guarantee the carbon equivalent and welding performance, the amount of Mn added according to the invention is kept at 0.50-1.40% so as to regulate the yield ratio and obdurability of the steel plate.

Cr: Cr may improve the hardenability of a steel plate and allow the formation of martensite structure during the cooling of the steel plate. However, an unduly high Cr content will increase the carbon equivalent of the steel plate and thus deteriorate the welding performance of the steel plate. Therefore, the Cr content in the invention is controlled at 0.20-0.70%.

Mo: Mo may inhibit the diffusional phase transformation effectively, and lead to the formation of high strength, low temperature transformation structure during the cooling of the steel plate. If the Mo content is low, the effect of inhibiting diffusional phase transformation of the steel plate can not be fully exerted, such that formation of more martensite structure is infeasible when the steel plate is cooled, leading to decreased strength of the steel plate. If the Mo content is unduly high, the carbon equivalent will be increased, such that the welding performance of the steel plate will be deteriorated. Therefore, the Mo content is controlled at 0.30-0.90% according to the invention.

Nb: Nb incorporated into steel may inhibit the grain boundary motion of austenite and lead to the recrystallization of a steel plate at high temperature. When austenization is performed at high temperature, Nb which is solid dissolved in austenite will form NbC particles at the sites of dislocations and grain boundaries due to the effect of strain-induced precipitation during rolling, thus inhibiting the grain boundary motion and improving the obdurability of the steel plate. If the Nb content is unduly high, coarse NbC particles may form and thus deteriorating the low temperature impact resistance of the steel plate. Therefore, Nb is added at an amount not more than 0.06% according to the invention to control the mechanical properties of the steel plate.

Ni: Ni may form a solid solution with Fe in steel, and improve the toughness of a steel plate by reducing lattice stacking fault. In order to obtain a high strength steel plate having good toughness at low temperature, a certain amount of Ni needs to be added into the steel plate. Ni may improve the stability of austenite, and lead to the formation of martensite and residual austenite structures during cooling of the steel plate, so as to reduce the yield ratio of the steel plate. If the Ni content is unduly high, firstly an oxide film, which is difficult to remove and affects the surface quality of the steel plate, will form when the slab is heated; and secondly the production cost of the steel plate will be increased. Therefore, the Ni content according to the invention shall be set in the range of 0.50-2.40%.

V: V is added into steel as an alloying element. It improves the obdurability of a steel plate by solid solution strengthening and precipitation strengthening of MC-type carbides. However, if the content of V element is unduly high, the MC-type carbides will be coarsened during the thermal treatment, and thus affecting the low temperature toughness of the steel plate. Therefore, not more than 0.06% of V is added according to the invention to ensure the mechanical properties of the steel plate.

Ti: Ti forms a nitride in molten steel, and subsequently forms a oxide and a carbide in a lower temperature range. However, an unduly high Ti content will result in the formation of coarse TiN in the molten steel. TiN particles have a cubic shape, and stress concentration tends to occur at the corners of the particles which are sources of crack formation. With the effects of Ti in steel taken into account comprehensively, the Ti content in the invention is controlled at 0.002-0.04%.

Al: Al is added into steel to refine grains via formation of oxides and nitrides. For the purpose of refining grains, improving the toughness of a steel plate and ensuring the welding performance of the steel plate, the content of Al to be added according to the invention is 0.01-0.08%.

B: B is enriched at grain boundaries in a steel plate, resulting in decreased grain boundary energy and formation of low temperature transformation structure during the cooling of the steel plate. The addition of B in steel, together with the modification of the contents of C and alloying elements, lead to the formation of high strength martensite structure and thus production of a steel plate having good strength performance. However, if the B content is unduly high, B will be enriched at the martensite grain boundaries, leading to decreased low temperature impact resistance and fatigue resistance of the steel plate. Therefore, B is added at an amount of 0.0006-0.0020% according to the invention.

N: N may form nitrides with Ti, Nb and V in steel. During austenization of a steel plate, undissolved nitrides may obstruct the grain boundary motion of austenite, and achieve the effect of refining austenite grains. If the content of N element is unduly high, N and Ti will form coarse TiN which will deteriorate the mechanical properties of the steel plate. Meanwhile, N atoms will be enriched at the flaws in the steel, leading to formation of porosity and cracking, which further exasperates the mechanical properties of the steel plate. Therefore, the N content in the invention is controlled to be not more than 0.0060%.

O: O forms oxides with Al, Si and Ti in steel. During austenization of a steel plate under heating, the oxides of Al have the effect of inhibiting austenite from growing large and thus refining the grains. However, a steel plate comprising a large amount of O has a propensity of hot cracking during welding. Therefore, the O content in the invention shall be controlled to be not more than 0.0040%.

Ca: Ca can be incorporated into steel, form CaS with S element and has the function of spheroidizing sulfides, so as to improve the low temperature impact toughness of a steel plate. The Ca content in the invention needs to be controlled to be not more than 0.0045%.

Accordingly, the invention further provides a process of manufacturing the ultra-high obdurability steel plate having a low yield ratio, comprising steps of smelting, casting, heating, rolling, cooling, quenching and tempering to produce a steel plate comprising a microstructure of refined martensite and residual austenite, wherein a slab is heated to 1080-1250° C. in the heating step; the quenching step adopts a quenching temperature of 860-940° C.; and the tempering step adopts a tempering temperature of 150-350° C.

With respect to the manufacture process, the temperatures adopted in the process steps of heating, quenching, tempering and the like are controlled respectively in the process of the invention for manufacturing the ultra-high obdurability steel plate having a low yield ratio. The control of the temperature is combined with the design of the elemental composition, so that the compositional design of the chemical elements and the manufacture process produce correlated effects. In the course of heating, the temperature is controlled between 1080-1250° C. to realize the austenization. This heating process is principally a process in which carbonitrides dissolve and austenite grains grow. For example, carbides or carbonitrides formed from carbide-forming elements such as Nb, V, Ti, Cr, Mo and the like dissolve partially in steel, and the atoms of alloying elements are solid dissolved in austenite by way of diffusion. In the course of rolling, part of the carbonitrides nucleate and grow at the flaws by the effect of strain-induced precipitation, refine the final grains, and thus improving the mechanical properties of the steel plate. In the course of quenching, the temperature is set between 860-940° C., as heating and soaking in this temperature range can effectively control the partial dissolution of the carbonitrides formed from carbide-forming elements (such as Nb, V, Ti, Cr, Mo and the like) and the size to which austenite grains grow. In the course of tempering, the tempering treatment is conducted by controlling the temperature in the heating furnace between 150-350° C. The tempering process of the steel plate is generally divided into four stages: 1) when the steel plate is tempered at 100° C., ε carbides precipitate in the martensite having a square lattice and decrease the squareness of martensite; while no ε carbides are formed in a steel comprising 0.3% or less carbon, and fine carbides are only formed in proximity to such flaws as dislocations, etc.; 2) at a temperature of around 235° C., residual austenite is transformed into lower bainite and martensite; 3) at a temperature of about 300° C., the ε carbides is transformed into cementite; and 4) at a temperature of 400-450° C., the diffusion coefficients of carbon and iron increase, and the cementite grains are coarsened. Tempering at about 150-350° C. is employed in the invention. As such, refined carbides precipitate at the edges of the refined martensite laths, and unlike dislocation annihilation occurs at positions in the steel plate where the dislocation density is very high. Hence, the inner stress in the steel plate is decreased, and the plasticity of the steel plate is increased. At this point, control of the tempering temperature allows a portion of the residual austenite to remain in the steel plate, lowering the final yield ratio of the steel plate, while imparting higher tensile strength to the steel plate.

In the above process of manufacturing the ultra-high obdurability steel plate having a low yield ratio, the rolled steel plate is air cooled or water cooled.

Furthermore, in the above process of manufacturing the ultra-high obdurability steel plate having a low yield ratio, the quenched steel plate is water cooled.

Furthermore, in the above process of manufacturing the ultra-high obdurability steel plate having a low yield ratio, the tempered steel plate is air cooled.

In comparison with the technical solutions of the prior art, owing to the use of a rational compositional design and an optimized manufacture process, the ultra-high obdurability steel plate having a low yield ratio of the present application possesses the following advantages: 1) having a lower carbon equivalent CEV and less alloying elements; 2) having a yield ratio of less than 0.85; 3) having a tensile strength of greater than 1500 MPa; 3) having a yield strength of greater than 1200 MPa; 4) having an elongation of greater than 10%; and 5) having various superior mechanical properties.

According to the process of the invention for manufacturing a ultra-high obdurability steel plate having a low yield ratio, a microstructure combining both soft and hard phases of refined martensite structure and residual austenite is obtained by optimization of temperature control without adding any procedure complexity or additional steps, affording a low yield ratio, ultra-high obdurability steel plate having desirable mechanical properties. The process schedule is flexible, and can be applied widely to steady production in the field of manufacturing engineering members having high requirements on structural safety.

DESCRIPTION OF DRAWING

FIG. 1 shows an optical micrograph of the microstructure of an ultra-high obdurability steel plate having a low yield ratio according to Example 4.

DETAILED DESCRIPTION OF THE INVENTION

The technical solution of the invention will be further illustrated with reference to the following specific Examples and the accompanying drawings of the specification, but the illustration is not intended to limit the invention unduly.

EXAMPLES 1-6

The following steps were followed to manufacture the ultra-high obdurability steel plate having a low yield ratio according to the invention.

1) Smelting: the formulation of the various chemical elements in mass percentages were controlled as particularly shown in Table 1;

2) Casting;

3) Heating: the slab was heated to 1080-1250° C.;

4) Rolling: the rolled steel plate was air cooled or water cooled;

5) Cooling: the steel plate was cooled to room temperature;

6) Quenching: the quenching temperature was 860-940° C., and water cooling was conducted after the quenching;

7) Tempering: the tempering temperature was 150-350° C., and air cooling was conducted after the tempering.

FIG. 1 shows an optical micrograph of the microstructure of an ultra-high obdurability steel plate having a low yield ratio according to Example 4 herein.

Table 2 shows the specific temperature parameters in Examples 1-6, wherein the specific temperature parameters of each Example in Table 2 correspond to the respective Examples 1-6 in Table 1.

TABLE 2

Specific temperature parameters adopted in the manufacture process of Examples 1-6

| Examples | Heating Temperature (° C.) | Quenching Temperature (° C.) | Tempering temperature (° C.) |
|---|---|---|---|
| 1 | 1250 | 940 | 150 |
| 2 | 1220 | 920 | 200 |
| 3 | 1180 | 900 | 250 |
| 4 | 1150 | 880 | 300 |
| 5 | 1120 | 870 | 330 |
| 6 | 1080 | 860 | 350 |

TABLE 3

Mechanical performance parameters of the ultra-high obdurability steel plates having low yield ratios according to Examples 1-6

| Examples | Yield Strength (MPa) | Tensile strength (MPa) | Yield Ratio (%) | Elongation (%) | Impact Energy −20° C. Akv (J) |
|---|---|---|---|---|---|
| 1 | 1350 | 1660 | 0.81 | 11 | 30/33/36 |
| 2 | 1320 | 1640 | 0.80 | 12 | 45/52/51 |
| 3 | 1330 | 1610 | 0.83 | 12 | 38/40/42 |
| 4 | 1305 | 1590 | 0.82 | 12 | 45/41/48 |
| 5 | 1285 | 1530 | 0.84 | 13 | 58/50/60 |
| 6 | 1250 | 1535 | 0.81 | 14 | 60/56/55 |

As can be seen from Table 3, the ultra-high obdurability steel plate having a low yield ratio according to the invention has a yield ratio of less than 0.85, a tensile strength of more than 1500 MPa, a yield strength of more than 1200 MPa, an elongation of more than 10%, and an impact energy Akv (−20° C.) of more than 27J. A steel plate having the above mechanical properties possesses ultra-high strength, good obdurability and superplasticity.

An ordinary person skilled in the art would recognize that the above examples are only intended to illustrate the invention without limiting the invention in any way, and all changes and modifications to the above examples will fall in the scope of the claims of the invention so long as they are within the scope of the substantive spirit of the invention.

TABLE 1

Mass percentages of the components of the ultra-high obdurability steel plates having low yield ratios according to Examples 1-6 (wt %, and the balance is Fe and other unavoidable impurities)

| Examples | C | Si | Mn | Cr | Mo | Nb | Ni | V | Ti | Al | B | N | O | Ca | CEV |
|---|---|---|---|---|---|---|---|---|---|---|---|---|---|---|---|
| 1 | 0.34 | 0.1 | 0.5 | 0.2 | 0.8 | 0 | 1.1 | 0.04 | 0.002 | 0.01 | 0.0006 | 0.004 | 0.003 | 0.003 | 0.704 |
| 2 | 0.3 | 0.2 | 0.6 | 0.3 | 0.5 | 0.01 | 2.4 | 0.01 | 0.006 | 0.02 | 0.0008 | 0.003 | 0.003 | 0.002 | 0.722 |
| 3 | 0.28 | 0.2 | 0.8 | 0.4 | 0.9 | 0.02 | 0.9 | 0.02 | 0.009 | 0.04 | 0.001 | 0.005 | 0.004 | 0.0045 | 0.737 |
| 4 | 0.25 | 0.2 | 1 | 0.5 | 0.5 | 0.03 | 1.2 | 0.03 | 0.012 | 0.05 | 0.0012 | 0.006 | 0.003 | 0.002 | 0.703 |
| 5 | 0.21 | 0.3 | 1.2 | 0.6 | 0.4 | 0.04 | 2 | 0 | 0.03 | 0.06 | 0.0016 | 0.003 | 0.004 | 0.001 | 0.743 |
| 6 | 0.18 | 0.4 | 1.4 | 0.7 | 0.3 | 0.06 | 1.5 | 0.06 | 0.04 | 0.08 | 0.002 | 0.004 | 0.003 | 0 | 0.725 |

Note:

CEV represents carbon equivalent, and CEV = C + Mn/6 + (Cr + Mo + V)/5 + (Ni + Cu)/15

What is claimed is:

1. An ultra-high obdurability steel plate having a low yield ratio, consisting of the chemical elements in mass percentages of:

C: 0.28-0.34%,
Si: 0.10-0.40%,
Mn: 0.50-1.40%,
Cr: 0.20-0.70%,
Mo: 0.30-0.90%,
Nb: 0%,
Ni: 0.9-2.40%,
V: from larger than 0% to 0.06%,
Ti: 0.002-0.04%,
Al: 0.01-0.08%,
B: 0.0006-0.0020%,
N≤0.0060%,
O≤0.0040%,
Ca: 0.002-0.0045%, and
the balance of Fe and other unavoidable impurities;

wherein the microstructure of the steel plate consists of refined martensite and residual austenite, and wherein the steel plate has a yield ratio of less than 0.85, a tensile strength of greater than 1500MPa, a yield strength of greater than 1200 MPa, and an elongation of greater than 10%.

2. The ultra-high obdurability steel plate having a low yield ratio according to claim 1, wherein the carbon equivalent of the steel plate satisfies the relation of CEV≤0.75%, wherein the carbon equivalent of CEV=C+Mn/6+(Cr+Mo+V)/5+(Ni+Cu)/15.

3. A process of manufacturing the ultra-high obdurability steel plate having a low yield ratio according to claim 1, comprising the steps of smelting, casting, heating, rolling, cooling, quenching and tempering to obtain the steel plate comprising a microstructure consisting of refined martensite and residual austenite; wherein a slab is heated to 1080-1250° C. in the heating step; the quenching step adopts a quenching temperature of 860-940° C.; and the tempering step adopts a tempering temperature of 150-350° C.

4. The process of manufacturing the ultra-high obdurability steel plate having a low yield ratio according to claim 3, wherein the steel plate is air cooled or water cooled after rolling.

5. The process of manufacturing the ultra-high obdurability steel plate having a low yield ratio according to claim 3, wherein the steel plate is water cooled after quenching.

6. The process of manufacturing the ultra-high obdurability steel plate having a low yield ratio according to claim 3, wherein the steel plate is air cooled after tempering.

7. The process of manufacturing the ultra-high obdurability steel plate having a low yield ratio according to claim 3, wherein the carbon equivalent of the steel plate satisfies the relation of CEV≤0.75%, wherein the carbon equivalent of CEV=C+Mn/6+(Cr+Mo+V)/5+(Ni+Cu)/15.

* * * * *